United States Patent [19]

LaPointe

[11] Patent Number: 4,993,777

[45] Date of Patent: Feb. 19, 1991

[54] RECLINER CHAIR LIFT BASE ASSEMBLY

[75] Inventor: Larry P. LaPointe, Temperance, Mich.

[73] Assignee: La-Z-Boy Chair Company, Monroe, Mich.

[21] Appl. No.: 425,384

[22] Filed: Oct. 18, 1989

Related U.S. Application Data

[63] Continuation of Ser. No. 196,750, May 20, 1988, abandoned.

[51] Int. Cl.[5] ..... A47C 1/02

[52] U.S. Cl. ..... 297/325; 297/DIG. 10; 297/330

[58] Field of Search ..... 297/325, DIG. 10, 326, 297/327, 328, 330, 338, 339, 344, 345, 195; 248/277, 421

[56] References Cited

U.S. PATENT DOCUMENTS

| | | | |
|---|---|---|---|
| 974,769 | 11/1910 | Hoff | 297/DIG. 10 X |
| 3,479,086 | 11/1969 | Sheridan | 297/DIG. 10 X |
| 4,007,960 | 2/1977 | Gaffney | 297/330 X |
| 4,083,599 | 4/1978 | Gaffney | 297/DIG. 10 X |
| 4,231,614 | 11/1980 | Shaffer | 297/330 |
| 4,344,594 | 8/1982 | Hirth | 297/330 X |
| 4,533,106 | 8/1985 | Stockl | 297/345 X |

FOREIGN PATENT DOCUMENTS

| | | | |
|---|---|---|---|
| 77280 | 4/1983 | European Pat. Off. | 297/DIG. 10 |
| 2515508 | 5/1983 | France | 297/DIG. 10 |
| 926157 | 5/1963 | United Kingdom | 297/339 |

*Primary Examiner*—Peter A. Aschenbrenner
*Attorney, Agent, or Firm*—Harness, Dickey & Pierce

[57] ABSTRACT

A lift base assembly for an upholstered recliner chair or the like comprises upper and lower frames with wooden outer surfaces and an electric motor operated linkage mechanism for elevating and tilting the upper frame on which a chair may be mounted.

23 Claims, 5 Drawing Sheets

FIG 3
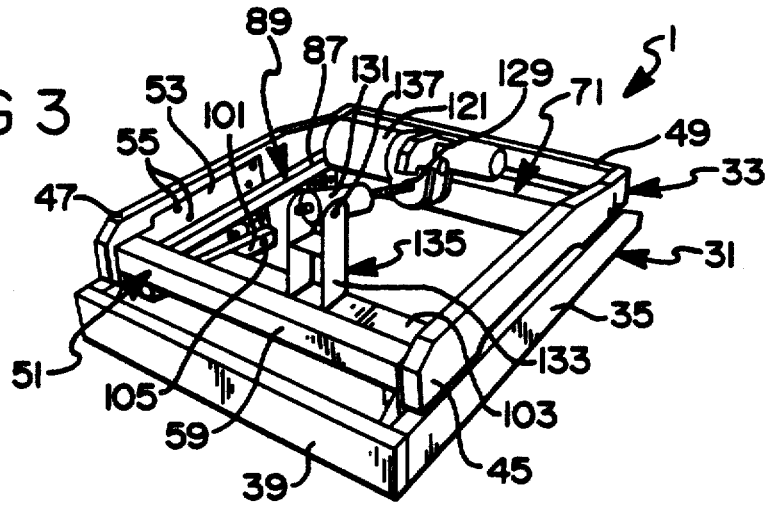
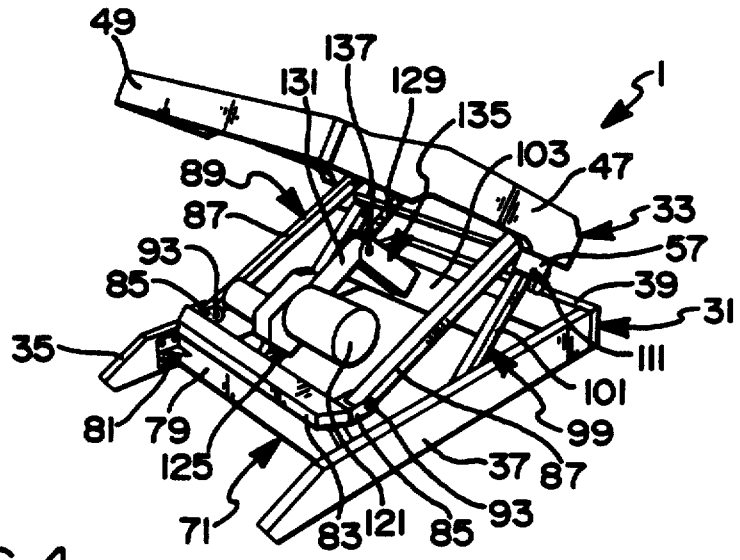
FIG 4

(69)
3
(283)
5
(281)
303
301
279
129
141
121
123
215
213
217
219
221
225
223
229
227
297
207
205
203
235
233
231
237
295
211
201
239
241
249
245
243
247
255
253
251
257
209
263
261
259
265
267
287
289
291
283
285
281
269
271
273
293
275
277

RECLINER CHAIR LIFT BASE ASSEMBLY

This is a continuation of U.S. patent application Ser. No. 196,750, filed May 20, 1988 now abandoned.

This invention relates to a lift base assembly that may be used with recliner and other type chairs to raise, lower, and tilt the chair thereby making it easier for a person to enter or leave the chair.

BRIEF SUMMARY OF THE INVENTION

It is a purpose of this invention to provide a low profile lift base assembly that is reliable and efficient in operation, durable, and relatively compact and simple in construction, and which is adapted to be used with upholstered recliner chairs as well as other chairs.

It is also a purpose of the invention to provide a lift base assembly which in the seating position of the chair has the outer appearance of an ordinary chair base.

Another purpose of the invention is to provide a lift base assembly for chairs that is driven by an electric motor and which includes means to disable the motor if the chair is in an improper condition for lifting or lowering or if an obstruction is encountered during movement of the assembly.

A lift base assembly according to a preferred form of the invention comprises a stationary bottom frame and a movable upper frame to which a chair may be secured. An electric motor operated linkage mechanism to move the upper frame and the chair is carried by the two frames. It nests inside of them, and the bottom of the chair, so that it is hidden when the chair is in the normal, seating position. Operation of the motor and linkage mechanism to raise or lower the upper frame is under the control of a hand-switch which may be actuated by a person using the chair. A limit switch prevents operation if the chair is not ready for movement, e.g., the leg rest is up or the back is reclined. The electric motor is of the type that senses a change in load on the power screw due to an obstruction between the upper and lower frames and disables itself to prevent application of a power load to the obstruction.

A preferred form of linkage mechanism for the lift base assembly of this invention includes a front and lower H-shaped lift bar that is pivoted to a central portion of the lower frame and to a front portion of the upper frame. It also includes a rear and upper U-shaped tilt bar that is pivoted to a rear portion of the lower frame and a front portion of the upper frame. The electric motor which drives the linkage is also pivoted to the rear of the lower frame and its rotary power screw extends through a nut that is pivoted to an upstanding bracket on the cross bar of the H-shaped lift bar. With this arrangement, rotation of the screw is one direction pulls the nut to the rear to raise the lift bar and elevate the upper frame. The weight of the chair and its occupant acts in opposition to rearward lift movement of the nut. This puts the screw shaft in tension and, as compared with compressive loads to which lift shafts are subjected in most designs, reduces the likelihood of shaft distortion and promotes reliable, durable, and efficient performance of the lift assembly.

Other features and advantages of the invention will become apparent upon consideration of the drawings and the description set forth hereinafter.

DESCRIPTION OF THE DRAWINGS

FIG. 3 is a somewhat schematic perspective view of the lift base assembly of FIGS. 1 and 2 taken from the front with the chair removed and the base in the seated or down position;

FIG. 4 is a somewhat schematic perspective view of the lift base assembly of FIG. 3 taken from the rear with the chair removed and the base in the fully extended or lift position;

DETAILED DESCRIPTION OF THE EMBODIMENT OF THE INVENTION

Figure 1:
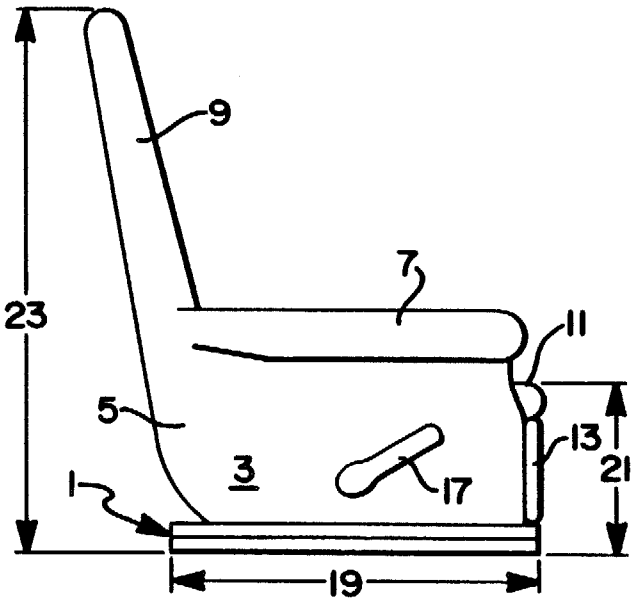
FIG. 1 is a diagrammatic side elevation of a reclinable upholstered chair, with extendible footrest, in seated position mounted on a lift base assembly embodying the invention.
Figure 2:
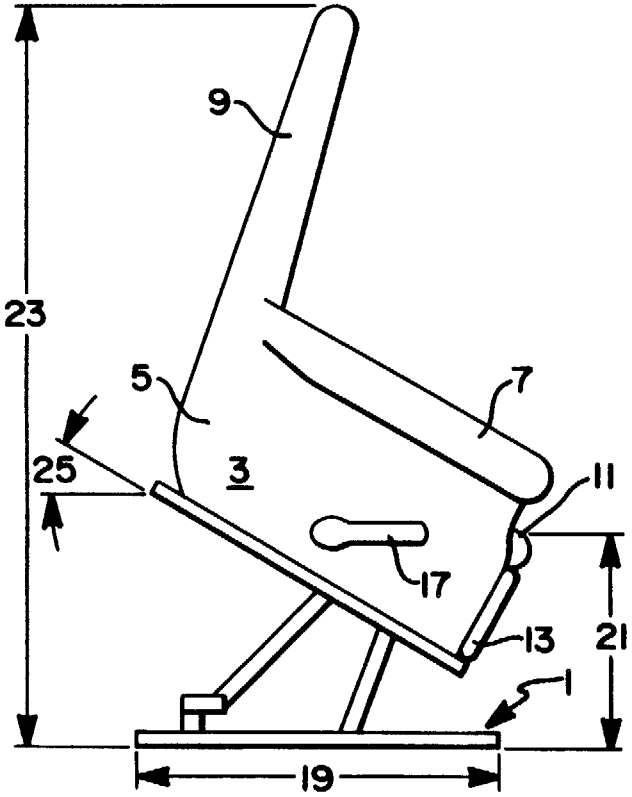
FIG. 2 is a view similar to FIG. 1 but showing the lift base in fully extended position wherein it has lifted the rear of the chair and has thereby tilted the chair, parts of the operating mechanism being omitted for clarity.

A lift base assembly 1 according to the present invention is shown in FIG. 1 supporting an upholstered chair 3 in a normal seated position. In FIG. 2 it is shown lifting the chair 3 to a tilted position that makes it easier for a person to enter or leave the chair. Any of a wide variety of chair constructions can be used with the base assembly 1. The well-known chair sold by the assignee hereof under the registered trademark RECLINA-REST is an example of one that can be mounted on the base 1 and it is shown very schematically in the drawings. U.S. Pat. No. 4,367,895, issued Jan. 11, 1983, entitled Reclinable Chair, shows many structural details of the RECLINA-REST chair. The chair 3 has a frame 5 with side arms 7, a back 9 that reclines in response to pressure from the back of an occupant, a seat 11 that moves simultaneously with the back 9, and an extendible leg rest 13. The leg rest is manually operated through mechanism (not shown herein but shown in U.S. Pat. No. 4,367,895) by a square cross shaft 15 (FIG. 5) that extends between the opposite sides of frame 5 and is turned by an external handle 17 located below the arm rest 7 where it can be easily reached by a person occupying the chair.

In the embodiment shown, the fore and aft length 19 of the base 1 is about 28⅞ inches in the seated position of FIG. 1 and in the fully extended position of FIG. 2. With the particular chair 3 selected as an example, the height 21 of the seat 11 above the floor is about 17 inches in the seated position of FIG. 1 and about 18 inches in the fully elevated position of FIG. 2. Normal height 21 for the chair 3 in the absence of the base 1 would be about 15 inches. The overall height 23 of the chair in the seated position of FIG. 1 is about 41 inches and in the fully extended position of FIG. 2 it is about 55 ½ inches. The angle of forward tilt 25 in the fully extended position of FIG. 2 is about 29 degrees.

The base assembly 1 has a stationary, rectangular, bottom frame member 31 that rests on the floor and a movable, rectangular, upper frame member 33 on which the chair 3 is removably but securely attached by suitable fasteners (not shown). The bottom member 31 includes wooden left and right hand side members 35 and 37, respectively, and these are rigid with a wooden front cross member 39. Side members 35 and 37 may have suitable pads 41 (FIG. 5) on the bottom to actually engage the floor.

Figure 6:
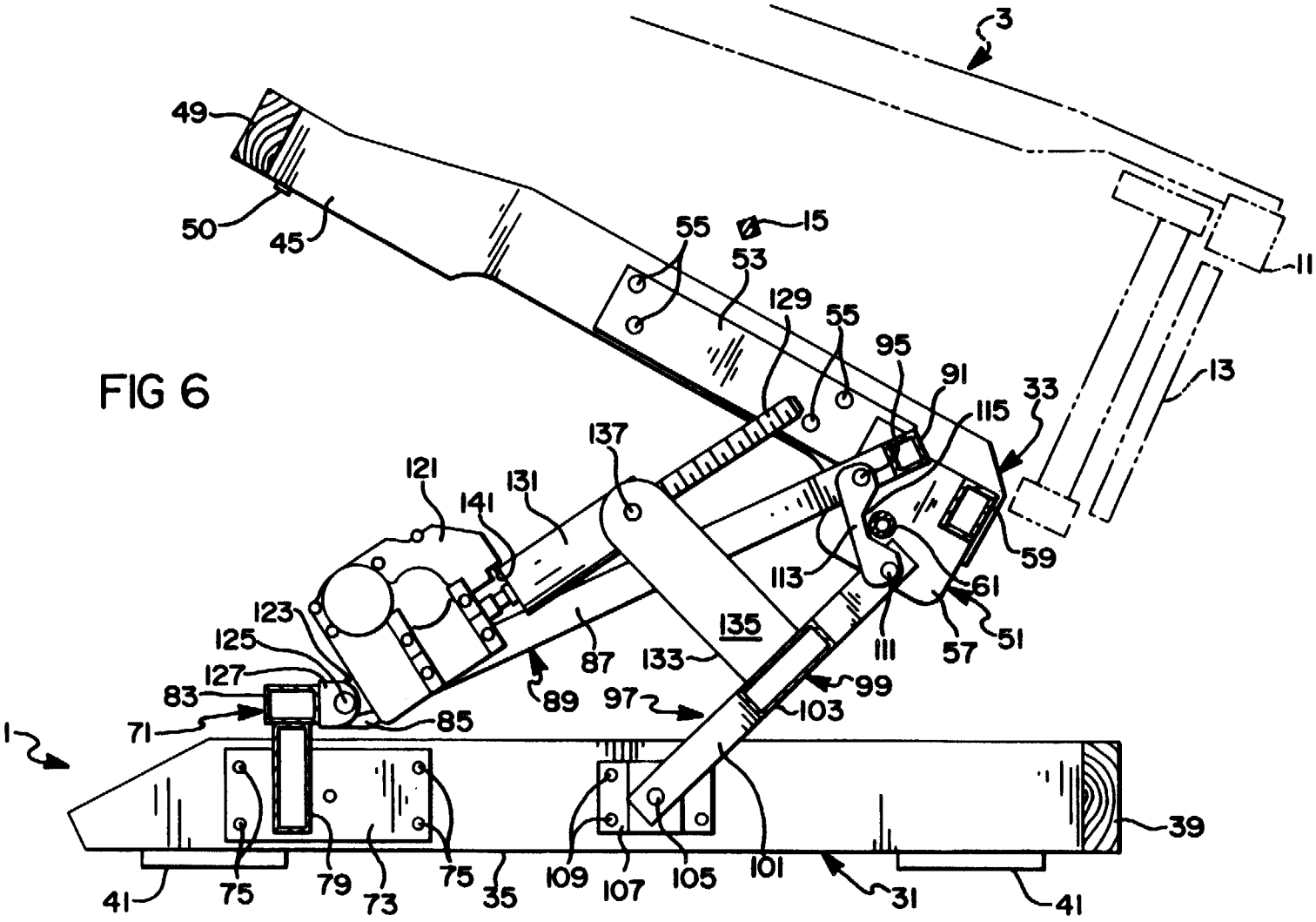
FIG. 6 is a vertical section through the base assembly of FIG. 4 but on an enlarged scale.

The upper frame member 33 has wooden left and right hand side members 45 and 47, respectively, and these are rigid with a wooden rear cross member 49. Soft rubber-like pads 50 (FIG. 6) on the bottoms of upper side members 45 and 47 help transfer vertical chair loads into bottom side member 35 and 37 in the seated position of the chair. The wooden outer portions of the assembly 1 give it the appearance of an ordinary chair base. The mechanism to be described nests inside of the wooden frame members and the bottom of the chair 3 and, as indicated above, the assembly 1 is of low profile and increases the seat height by only about 2 inches.

The front of the upper frame member 33 is reinforced by a U-shaped metal pivot bracket 51. This has metal side plates 53 that are securely affixed to the inside faces of the wooden side members 45 and 47 as indicated at 55. The front ends of the side plates are rigid with reinforcement and pivot plates 57 which extend below the wooden sides 45 and 47 into the confines of the lower frame 31 as seen best in FIG. 6. The metal pivot bracket 51 includes a rectangular tube 59 that is a front cross piece extending between the plates 57 on opposite sides and made rigid with them, as by welding. A round metal tubular cross bracing piece 61 located somewhat below and to the rear of cross piece 59 also extends between the plates 57 and is made rigid with them, as by welding.

The rear of the lower frame member 31 is reinforced by a transverse metal pivot bracket member 71 that includes metal side plates 73 that are securely affixed to the inside faces of the wooden side members 35 and 37 as indicated at 75. The pivot bracket 71 also includes a rectangular tube 79 that is a rear cross piece extending between the plates 73 on opposite sides and made rigid with them, as by welding and gussets 81 (FIG. 4). Another transverse rectangular tube 83 is seated on top of tube 79 and is made rigid with it, as by welding. Tubes 79 and 83 form a T-shaped load carrying component of the lift base assembly 1. The height of tube 79 is such that tube 83 is located within the confines of upper frame 33.

The top tube 83 terminates at each end a slight distance inwardly from side plates 73. At each end, i.e., adjacent the side legs 45 and 47, it has U-shaped bracket 85 rigidly affixed to it, as by welding. These receive the rear ends of the side legs 87 of a U-shaped upper tilt bar member 89. The legs 87 are formed of square metal tubing and at their front ends they are rigidly affixed, as by welding, to opposite ends of a front cross piece 91, also a square metal tube. The rear ends of the upper tilt bar side legs 87 and fit inside the U-shaped brackets 85 on lower frame member 31 are pivoted to the opposite sides of the brackets as indicated at 93. As seen best in FIG. 5, the height of combined tubes 79 and 83 is such that the side legs 87 are substantially horizontal when the lift assembly 1 is in the fully lowered or seated position. The upper or front ends of the side legs 87 are pivoted to the pivot plates 57 on the front of the upper frame member 33 as indicated at 95.

The tilt bar member 89 is a part of the linkage mechanism 97 for operating the assembly 1. This mechanism also includes a lower lift bar member 99 that is pivoted at its rear end to a central portion of the lower frame member 31 and at its upper end to the pivot plates 57 of the upper frame member 33. The lower lift bar member 99 is substantially H-shaped and has left and right hand side legs 101 that are spaced apart the same amount as side legs 87 of the upper tilt bar 89 and are also formed of square metal tubing of the same cross section whereby the legs 101 are coplanar with the legs 87, though substantially shorter in length. A rectangular metal tube 103, similar to tube 79, extends between the side legs 101 and its opposite ends are made rigid with them, as by welding, at central portions of the legs 101 and as seen best in FIG. 6. The lower and rear ends of the side legs 101 are pivoted at 105 to brackets 107 that are rigidly affixed to the inside faces of side legs 35 and 37, as indicated at 109. The upper and front ends of the legs 101 are pivoted to lower portions of the square pivot plates 57 as indicated at 111. Reinforcement bars 113 to maintain parallelism of upper and lower pivots 95 and 111 are also connected at their upper and rear ends to the pivot plates 57 by way of pivots 95 and at their lower and front ends to the pivot plates 57 by way of pivots 111. The bars 113 are cutout at 115 so that they can pass close to the rear of round cross brace tube 61.

Figure 5:
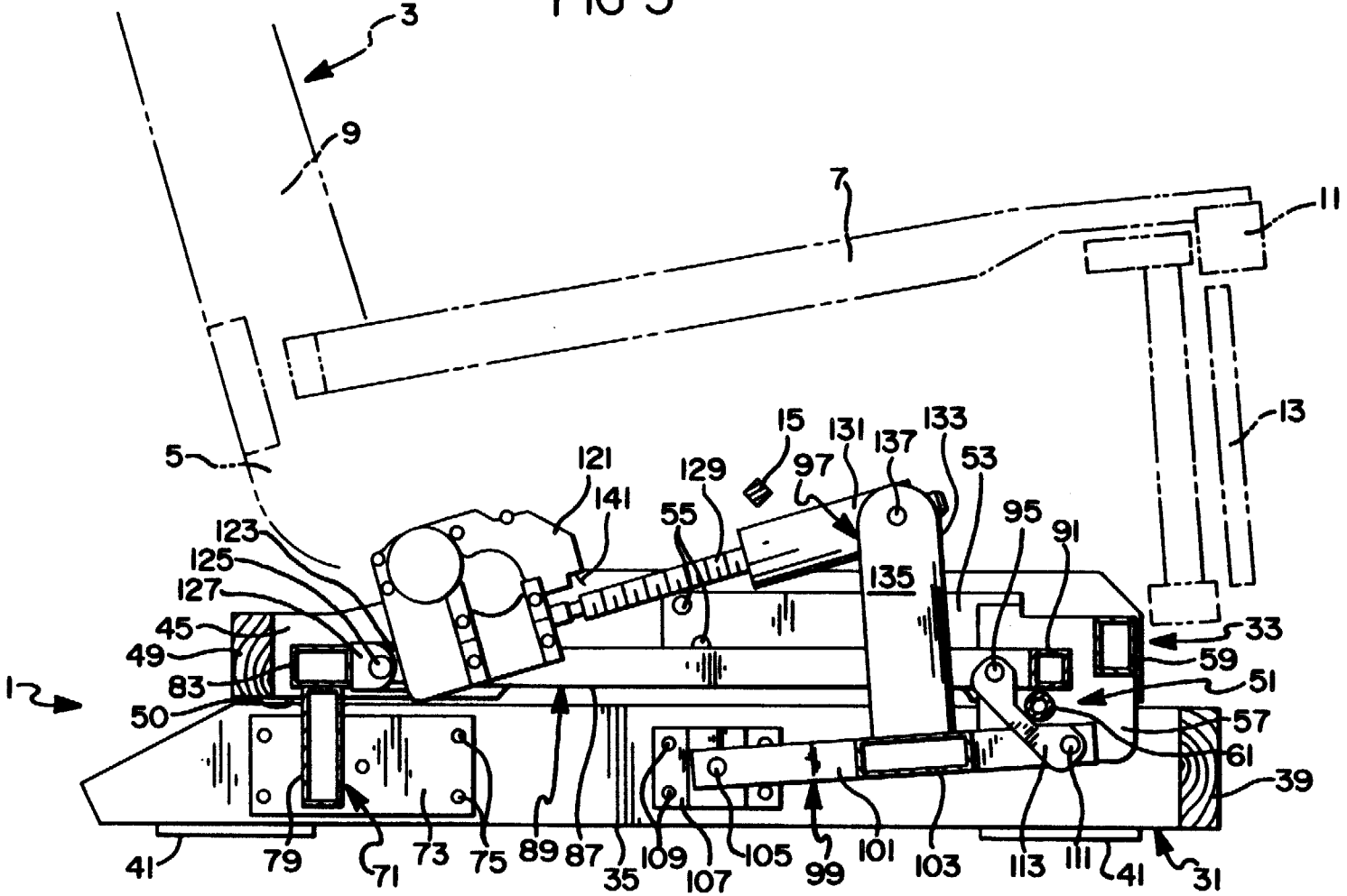
FIG. 5 is a vertical section through the base assembly of FIG. 3 but on an enlarged scale.

As seen in FIG. 5 the parts of the tilt bar 89 and the lift bar 99, forming linkage mechanism 97, are confined within the rectangular upper and lower frames 33 and 31, respectively, when the assembly is in the lowered or seating position. Thus, the mechanism is low profile and compact.

An electric motor 121 is connected to the lower lift bar 99 to pivot it up or down about the pivots 105 and thereby drive the linkage mechanism 97. The motor 121 has a rigid rearwardly extending flange 123 and this fits between and is pivoted at 125 to the two sides of a U-shaped pivot bracket 127 that is welded to a central portion of the top cross piece 83 of the pivot bracket member 71 of the lower base member 31. The motor 121 rotates a screw shaft 129 in either direction. Both the motor 121 and its rotary screw shaft 129 can arcuately swing up and down in a vertical plane about the pivot 125. The shaft 129 extends through and drives an internally threaded sleeve or nut 131 so that the sleeve moves forwardly or rearwardly along the length of the shaft. The front end of the sleeve 131 is located between the sides 133 of the tall U-shaped pivot bracket 135 and is pivoted to them as indicated at 137, the axis of pivot 137 being parallel to but between the axes of pivots 105 and 111. The bracket 135 is centrally located on top of cross piece 103 of the lower lift bar 99 and is made rigid with it, as by welding. As seen best in FIG. 5, the bracket 135 projects only a little above the confines of upper frame 33, within available space inside the chair 3, thereby maintaining the compactness and low profile of the assembly 1.

Comparing FIGS. 5 and 6, or FIGS. 3 and 4, it will be seen that in the seating or lowered position of the chair 3, the sleeve 131 is near the front or outer end of the threaded motor shaft 129. Lifting of the chair 3 is accomplished by energizing the motor 121 to rotate the shaft 129 in a direction that draws the sleeve 131 toward the motor. This pulls the pivot 137 to the rear causing the lift bar member 99 to pivot upwardly about pivots 105. This upward movement is transmitted through pivots 111 at the front ends of the member 99 into lifting of the upper member 33. The path of lift movement is determined by lower lift bar side legs 101 and also by the longer upper tilt bar side legs 87. Front pivots 95 on the upper frame 33 lift the front ends of side legs 87 which therefore pivot upwardly about their rear pivot connections 93 to the lower frame member 31. The upper tilt arm 89 has a larger vertical component of travel during lifting than does the lower lift arm member 99. The rear end of the chair 3 is therefore tilted upwardly about pivots 111 in amounts proportional to the amount of lift. As previously indicated (FIG. 2), a chair entry and exit angle 25 of about 29 degrees is preferable. This is determined by contact of the rear end of sleeve 131 with the limit switch trigger 141 on the motor 121 which opens the electrical circuit and stops the motor. To lower the chair 3, rotation of the shaft 129 is reversed.

The motor 121 is preferably of a type that has means to sense a change in the state of force on the linkage system and to disable the motor in response to such a change. A motor of this type is sold by Maxwell Products, Inc. of Cerritos, Cal. and is described in U.S. Pat. No. 4,407,030, issued Oct. 4, 1983, entitled "Safety Device for an Adjustable Bed." It will be seen that in the present construction the weight of the chair 3 and an occupant of the chair will place a downward force on the pivots 111 and that this will apply a forward force to pivots 137, thus putting the screw 129 in tension. If a foreign object or resistance is encountered by the upper member 33 as it is being lowered, there will be a change in the tension load on screw shaft 129 since the effect of the obstruction will be to apply an opposite load (i.e. compression) to the screw. The motor 121 referred to has means incorporated in its assembly to sense this change of state and disable the motor until the obstruction is removed. When the upper frame 33 is lowered to the degree that it contacts the lower frame by way of pads 50, the motor 121 will sense the change in resistance and be shut off.

Figures 7, 7A:
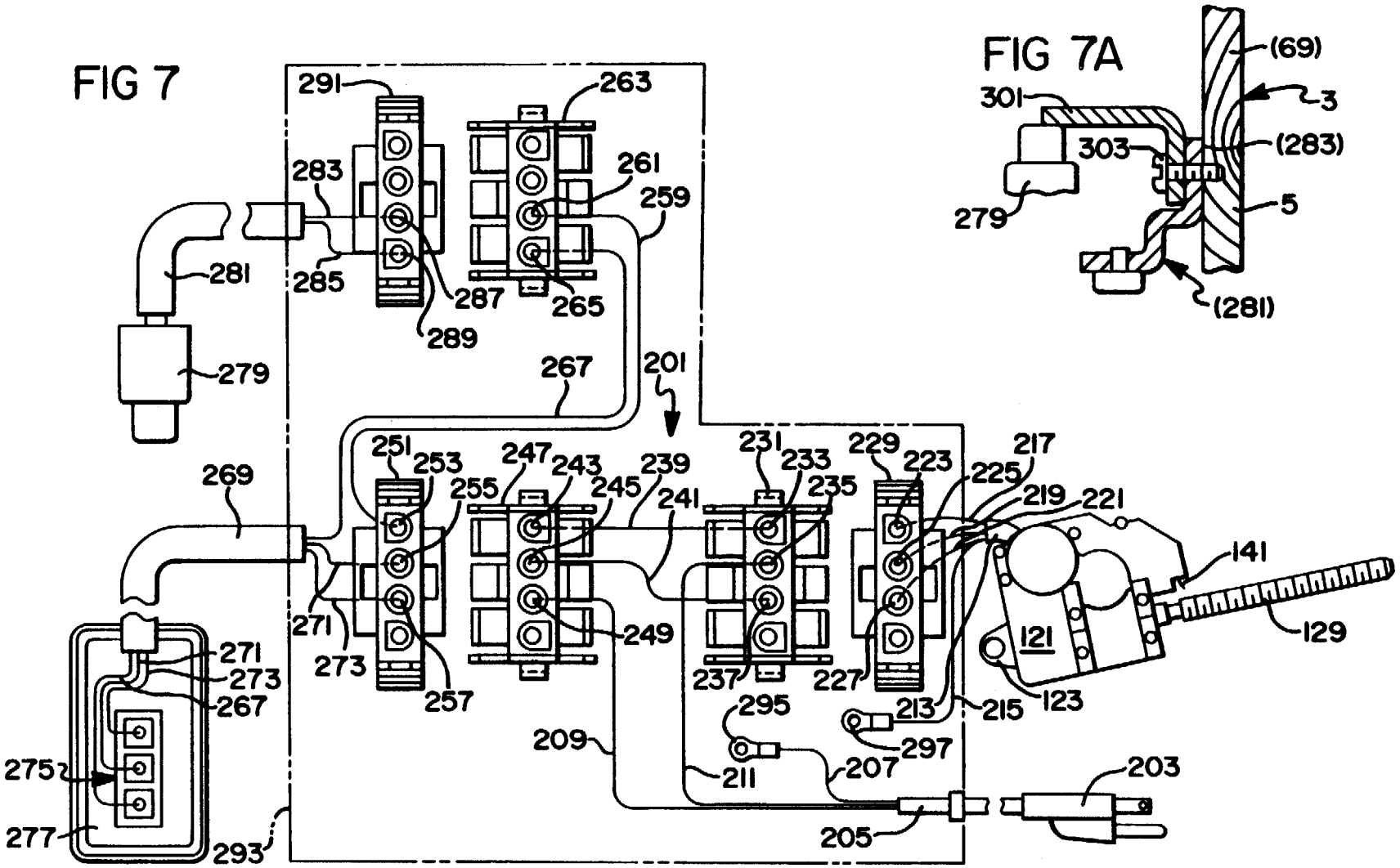
FIG. 7 is a wiring diagram for the assembly.
FIG. 7A is a schematic view showing operation of the stop switch by the chair.

Referring to FIG. 7, the electrical control system 201 for the motor 121 includes a three-prong grounding attachment plug 203 to fit into a grounding-type electrical receptacle (not shown) in the place where the base 1 is used that provides electrical current to operate the lift assembly. The plug 203 has an insulated cable or power cord 205 of suitable length containing a grounding conductor 207 and two current carrying conductors 209 and 211.

The motor 121 has an insulated power cord 213 which contains a grounding conductor 215 and three current carrying conductors 217, 219, and 221. The three current carrying conductors 217, 219, and 221 are connected to terminals 223, 225, and 227, respectively, of a male socket 229.

Socket 229 mates with female socket 231 so that male socket terminals 223, 225, and 227 are electrically connected to female socket terminals 233, 235, and 237, respectively. Current carrying conductor 211 of power cord 205 is connected to female socket terminal 235.

The other terminals 233 and 237 of female socket terminal 235 are connected by conductors 239 and 241, respectively, to terminals 243 and 245, respectively, of a second female socket 247. A third terminal 249 of female socket 247 is connected to current carrying conductor 209 of power cord 205.

Socket 247 mates with male socket 251 so that male socket terminals 253, 255, and 257 are electrically connected to terminals 243, 245, and 249, respectively, of female socket 247.

Terminal 253 of male socket 251 is connected by conductor 259 to terminal 261 of a third female socket 263. A second terminal 265 of socket 263 is connected to conductor 267 contained in hand control cord 269. Hand control cord 269 also contains conductor 271 which is electrically connected to terminal 255 of male socket 251 and conductor 273 which is electrically connected to terminal 257 of male socket 251.

Hand control cord 269 terminates in a hand operated switch 275 within housing 277 that may be held and operated by a person using the chair 3. When the switch is operated to connect conductors 271 and 273 electrical power is supplied to motor 121 to rotate the screw shaft 129 in a direction to cause the chair to lower. When the switch 275 is operated to connect conductors 271 and 267 power is supplied to elevate the chair provided that the shut-off switch 279 is made or closed.

Shut-off switch 279 has a cord 281 containing current carrying conductors 283 and 285. Conductors 283 and 285 are electrically connected to terminals 287 and 289, respectively, of a male socket 291. Socket 291 mates with female socket 263 to electrically connect its terminals 287 and 289 to terminals 261 and 265, respectively, of the female socket.

The sockets 229, 231, 243, 251, 263, and 291 are preferably housed within a metal junction box 293 that may be rigidly secured (not shown) to cross piece 79 at the rear of lower frame member 31. The grounding wires 207 and 215 have terminals 295 and 297, respectively that may be connected (not shown) to the metal box.

Referring to FIG. 7A, the reference numbers in parentheses (i.e., 69, 281, and 283) are reference numbers used in the aforementioned U.S. Pat. No. 4,367,895 (see FIG. 6 of the patent) to designate certain structural features of the chair shown in that patent. As already indicated, the chair 3 herein may embody construction features shown in the patent (though the tracks 29 and related parts providing fore and aft movement responsive to back recline will be omitted in chair 3). A feature of chair 3 and the chair in the patent is that the body 5 tilts to raise the front edge whenever the leg rest 13 is moved away from its stowed position shown herein and whenever the back 9 is reclined from its upright position shown herein. Thus, tilt of the body 5 signifies that the leg rest 13 is at least partially elevated and/or the back 9 is at least partially reclined. Reference number (69) in the patent designates a front vertical post in body 5 located approximately midway between the left and right sides of the chair. It will move up due to tilt of the body 5. Thus, as shown in FIG. 7A, an angle shaped bracket 301 may be secured by screw 303 to post (69) in such a position that it engages and makes stop switch 279 when the chair 3 is in its fully upright position with the leg rest 13 all the way down, i.e., the untilted position.

As seen from the circuit diagram of FIG. 7, if the stop switch 279 and the switch 275 is pressed to interconnect conductors 267 and 271, current is able to flow through the various conductors to rotate the lift motor 121. On the other hand, if switch 279 is open due to bracket 302 being raised by tilt of body 5, current cannot reach the motor. It is preferred that this control by switch 279 be applied to the lift mode so that the chair and upper frame 33 will not elevate if the back 9 is reclined or the leg rest 13 is elevated. On the other hand, if the switch 275 is pressed to interconnect conductors 273 and 271, current is able to flow through the various conductors to rotate the lift motor 121 in a direction to lower the chair.

In the lowered position of the lift base assembly, the wooden outer parts of the lower and upper frames 31 and 33 give the appearance of an ordinary base for the chair 3. The compact, low profile of the electric motor and linkage mechanism enable it to fit for the most part within the confines of the upper and lower frames, inside the bottom of the chair 3, and below the cross shaft 15.

When circuit 201 is activated by way of switch 275 to elevate the upper frame 33, the lift motor 121 will rotate the screw shaft 129 in a direction to pull the nut 131 toward the rear of the assembly 1 and the motor. Such movement of nut 131 pulls its pivot 137 to the rear and it pulls the top of bracket 135. The bracket 135 as a part of the sturdy H-shaped lift bar member 99 causes the bar member to pivot upwardly about pivots 105 on the lower frame 31 and this is accompanied by upward pivoting of motor 121 moving the screw shaft 129 upwardly in an arcuate path. The upward movement of lift bar member 99 raises the pivots 111 that it has at its front ends to the plates 57 of the upper frame 33 thereby raising the front end of the upper frame. However, the sturdy U-shaped tilt bar member 89 is also pivoted at 91 to the plates 57 and as these pivots are elevated the member 89 pivots upwardly about its pivots 93 to the rear cross piece 71 of the lower frame. Since tilt member 89 is longer than lift member 99, it forces the upper frame 33 to tilt about the axis of lift member pivots 111 thereby raising the rear of the frame 33 so that the frame 33 goes from a substantially horizontal lowered position to an inclined elevated position. When the nut 131 reaches the switch 141, the motor is stopped, holding the chair 3 in the position of FIGS. 2 and 6 in which it is somewhat easier for a person to be seated or to leave the chair.

When it is desired to lower the chair, the circuit 201 is activated by way of switch 275 to lower the upper frame 33. The lift motor 121 will rotate the screw shaft 129 in a direction to move the nut forwardly away from motor 121. This will produce action of the linkage mechanism 97 which is the reverse of that just described. When the upper frame 33 engages the lower frame 31, or if an obstruction is encountered before complete lowering, the motor 121 will sense the change in load on shaft 129 and shut off as previously described.

During both elevation and lowering, the upper frame 33 can be stopped in any desired position by discontinuing actuation of the switch 275. As can be seen, the sturdy, rugged construction of the linkage mechanism 97 enables it to solidly support the weight of a chair and occupant with stability and durability.

Modifications in the specific details illustrated may be made without departing from the spirit and scope of the invention.

What is claimed is:

1. A lift base assembly for use with upholstered recliner chairs and the like to provide means for elevating and tilting the chair, said assembly comprising a stationary rectangular lower frame adapted to rest on a floor, a movable rectangular upper frame, said upper frame providing means on which a chair may be mounted, a lift bar member pivoted at one end to a central portion of the lower frame and extending longitudinally forwardly from said pivot, the other and front end of said lift bar member being pivoted to the front end of the upper frame, an electric motor having a rotary screw shaft, said motor being pivoted to a rear portion of said lower frame for arcuate motion of said screw shaft in a vertical plane, a pivot bracket on said lift bar and extending upwardly within the confines of the upper frame when the lift assembly is in lowered position, a screw shaft nut pivoted to an upper portion of said pivot bracket on a pivot axis parallel to and located between the pivot axes of the lift bar pivots to the lower frame and the upper frame, said screw shaft extending through and having a threaded connection with said nut whereby rotation of the screw shaft produces longitudinal movement of the nut along the length of the screw shaft and pivoting of the lift bar, longitudinal movement of the nut toward the rear producing elevation of the upper frame and longitudinal movement of the nut toward the front producing lowering of the upper frame, and tilt means connected to the upper frame producing pivoting of the upper frame about the pivot axis of the lift bar pivot to the upper frame when the upper frame is elevated or lowered.

2. An assembly as set forth in claim 1 wherein the exterior portions of the sides of the upper and lower frames, as well as the front of the lower frame and the back of the upper frame, are formed of wood to provide the appearance of a wooden base for a chair when the assembly is in lowered position.

3. An assembly as set forth in claim 1 including means whereby the gravity load of a chair and a chair occupant applies load on said screw shaft nut urging the nut to move away from the motor so that the screw shaft is loaded in tension.

4. An assembly as set forth in claim 3 wherein said electric motor is of the type that senses a change in load on the screw shaft and shuts itself off in response to a predetermined change in such load on the screw shaft.

5. An assembly as set forth in claim 1 including electrical circuit means for operating said motor, said circuit means including switch means responsive to condition of a chair on the lift assembly and acting to open the circuit means if the chair is not in a predetermined condition.

6. An assembly as set forth in claim 5 wherein said electrical motor is of the type that includes means for opening the circuit means in response to a predetermined change in load on the screw shaft.

7. An assembly as set forth in claim 1 wherein said lower frame includes a transverse pivot bracket member adjacent the rear of the frame, said motor being pivoted to said bracket member.

8. An assembly as set forth in claim 1 wherein said tilt means comprises a tilt bar member pivoted at its rear end to said lower frame and extending longitudinally forwardly from said rear end pivot and being located substantially within the confines of the upper frame when the assembly is in lowered position, the front end of the tilt bar member being pivoted to the front end of the lower frame.

9. An assembly as set forth in claim 8 wherein said upper frame includes pivot plate means at its front end, said lift bar member being pivoted to said pivot plate means, said tilt bar member being pivoted to said pivot plate means.

10. An assembly as set forth in claim 9 wherein said lower frame includes a transverse pivot bracket member adjacent the rear of the lower frame, said transverse pivot bracket member having a top portion located within the confines of the upper frame when the assembly is in lowered position, said tilt bar member being pivoted at its rear end to said top portion of said transverse pivot bracket member.

11. An assembly as set forth in claim 10 wherein said motor is pivoted to said top portion of said transverse pivot bracket member.

12. An assembly as set forth in claim 11 wherein the pivot axis of said screw shaft nut pivot is located on a level substantially above said pivots to said plate means and to said top portion of said transverse pivot bracket member.

13. An assembly as set forth in claim 12 wherein said lift bar member is substantially H-shaped with side legs and a central cross piece between the side legs, said pivot bracket being rigidly secured to a central portion of said cross piece.

14. An assembly as set forth in claim 13 wherein said tilt bar is substantially U-shaped with side legs and a transverse base, said base being located at the front of said tilt bar.

15. An assembly as set forth in claim 14 including means to maintain a predetermined spacing between the pivot axis of the lift bar and the pivot plate means and the pivot axis of the tilt bar and the pivot plate means and to maintain parallelism of said axes.

16. An assembly as set forth in claim 14 wherein the exterior portions of the sides of the upper and lower frames as well as the front of the lower frame and the back of the upper frame are formed of wood to provide the appearance of a wooden base for a chair when the assembly is in lowered position.

17. An assembly as set forth in claim 16 including circuit means for operating said motor, said circuit means including switch means responsive to condition of a chair on the lift assembly and acting to open the circuit means if the chair is not in a predetermined condition.

18. An assembly as set forth in claim 17 wherein said switch means acts to prevent elevation of the lift assembly if the chair is not in a predetermined condition.

19. An assembly as set forth in claim 18 wherein said electric motor is of the type that senses a change in load on the screw shaft and shuts itself off in response to a predetermined change in such load on the screw shaft such as provided by an obstruction to motion of the upper frame.

20. An assembly as set forth in claim 19 wherein gravity load on the lift bar tends to pull the nut forwardly on the screw shaft and put the screw shaft in tension.

21. An assembly as set forth in claim 20 wherein engagement of the upper frame with the lower frame upon lowering of the lift assembly produces a change in load on the screw shaft that shuts off the motor.

22. An assembly as set forth in claim 21 wherein said motor includes shut-off switch means engageable by said nut after predetermined rearward movement of the nut to shut off said motor when the upper frame reaches a predetermined elevation and tilt.

23. A lift base assembly as set forth in claim 1 wherein said lift bar member is located substantially within the confines of the lower frame when the lift assembly is in a fully lowered position.

* * * * *